US008292985B2

(12) United States Patent
Curry et al.

(10) Patent No.: US 8,292,985 B2
(45) Date of Patent: Oct. 23, 2012

(54) MATERIALS FOR ENHANCING THE DURABILITY OF EARTH-BORING BITS, AND METHODS OF FORMING SUCH MATERIALS

(75) Inventors: David A. Curry, The Woodlands, TX (US); James L. Overstreet, Tomball, TX (US); Jimmy W. Eason, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 721 days.

(21) Appl. No.: 12/391,690

(22) Filed: Feb. 24, 2009

(65) Prior Publication Data

US 2009/0260482 A1 Oct. 22, 2009

Related U.S. Application Data

(62) Division of application No. 11/545,914, filed on Oct. 11, 2006, now Pat. No. 7,510,034.

(60) Provisional application No. 60/725,447, filed on Oct. 11, 2005, provisional application No. 60/725,585, filed on Oct. 11, 2005.

(51) Int. Cl.
*C22C 29/08* (2006.01)
*C22C 1/04* (2006.01)

(52) U.S. Cl. ..... 75/240; 419/18

(58) Field of Classification Search ..... 75/240; 419/18

See application file for complete search history.

(56) References Cited

U.S. PATENT DOCUMENTS

| | | | |
|---|---|---|---|
| 2,179,836 | A | 11/1939 | Wisler et al. |
| 3,800,891 | A | 4/1974 | White et al. |
| 5,038,640 | A | 8/1991 | Sullivan et al. |
| 5,090,491 | A | 2/1992 | Tibbitts et al. |
| 5,467,836 | A | 11/1995 | Grimes et al. |
| 5,505,902 | A | 4/1996 | Fischer et al. |
| 5,663,512 | A | 9/1997 | Schader et al. |
| 5,856,626 | A | 1/1999 | Fischer et al. |
| 5,887,242 | A | 3/1999 | Nygren et al. |
| 5,902,942 | A | 5/1999 | Maderud et al. |
| 5,993,730 | A | 11/1999 | Waldenstrom |

(Continued)

FOREIGN PATENT DOCUMENTS

EP 1022350 A2 7/2000

(Continued)

OTHER PUBLICATIONS

Kim, Chang-Soo, et al., "Modeling the relationship between microstructural features and the strength of WC-Co composites," International Journal of Refractory Metals & Hard Materials, vol. 24, pp. 89-100, 2006.

(Continued)

*Primary Examiner* — Roy King
*Assistant Examiner* — Ngoclan T Mai
(74) *Attorney, Agent, or Firm* — TraskBritt

(57) ABSTRACT

An earth-boring drill bit having a bit body with a cutting component formed from a tungsten carbide composite material is disclosed. The composite material includes a binder and tungsten carbide crystals comprising sintered pellets. The composite material may be used as a hardfacing on the body and/or cutting elements, or be used to form portions or all of the body and cutting elements. The pellets may be formed with a single mode or multi-modal size distribution of the crystals.

15 Claims, 8 Drawing Sheets

U.S. PATENT DOCUMENTS

| | | | | |
|---|---|---|---|---|
| 6,126,709 | A | 10/2000 | Akerman et al. | |
| RE37,127 | E | 4/2001 | Schader et al. | |
| 6,210,632 | B1 | 4/2001 | Ostlund et al. | |
| 6,214,287 | B1 | 4/2001 | Waldenstrom et al. | |
| 6,221,479 | B1 | 4/2001 | Waldenstrom et al. | |
| 6,248,149 | B1 | 6/2001 | Massey et al. | |
| 6,294,129 | B1 | 9/2001 | Waldenstrom | |
| 6,352,571 | B1 | 3/2002 | Waldenstrom et al. | |
| 6,423,112 | B1 | 7/2002 | Kerman et al. | |
| 6,468,680 | B1 | 10/2002 | Waldenstrom et al. | |
| 6,626,975 | B1 | 9/2003 | Gries et al. | |
| 6,673,307 | B1 | 1/2004 | Lindholm et al. | |
| 6,692,690 | B2 | 2/2004 | Kerman et al. | |
| 6,749,663 | B2 | 6/2004 | Bredthauer et al. | |
| 6,887,296 | B2 | 5/2005 | Mende et al. | |
| 7,250,069 | B2 | 7/2007 | Kembaiyan et al. | |
| 2004/0060742 | A1 * | 4/2004 | Kembaiyan et al. | 175/434 |
| 2006/0191723 | A1 | 8/2006 | Keshavan | |

FOREIGN PATENT DOCUMENTS

| | | | |
|---|---|---|---|
| EP | 0819777 | B1 | 10/2000 |
| EP | 0916743 | B1 | 3/2002 |
| EP | 0927772 | B1 | 5/2002 |
| EP | 1043412 | B1 | 10/2002 |
| EP | 1105546 | B1 | 5/2003 |
| GB | 1574615 | | 9/1980 |
| GB | 2401114 | A | 11/2004 |
| JP | 09125185 | | 5/1997 |
| JP | 09125185 | A | 5/1997 |
| WO | 9803691 | A1 | 1/1998 |
| WO | 0003049 | A1 | 1/2000 |
| WO | 03049889 | A2 | 6/2003 |

OTHER PUBLICATIONS

PCT International Search Report (Pub. No. Wo 2007/044871 A3) for International Application No. PCT/US2006/039984, mailed May 25, 2007.

* cited by examiner

MATERIALS FOR ENHANCING THE DURABILITY OF EARTH-BORING BITS, AND METHODS OF FORMING SUCH MATERIALS

CROSS-REFERENCE TO RELATED APPLICATIONS

This application is a divisional of U.S. application Ser. No. 11/545,914, filed Oct. 11, 2006, now U.S. Pat. No. 7,510,034, issued Mar. 31, 2009, and claims priority to U.S. Provisional Patent Application Ser. No. 60/725,447, filed on Oct. 11, 2005, and to U.S. Provisional Patent Application Ser. No. 60/725,585, filed on Oct. 11, 2005, the disclosure of each of which is incorporated herein in its entirety by this reference.

BACKGROUND OF THE INVENTION

1. Technical Field

The present invention relates in general to earth-boring bits and, in particular, to an improved system, method, and apparatus for enhancing the durability of earth-boring bits with carbide materials.

2. Description of the Related Art

Typically, earth boring drill bits include an integral bit body that may be formed from steel or fabricated of a hard matrix material, such as tungsten carbide. In one type of drill bit, a plurality of diamond cutter devices are mounted along the exterior face of the bit body. Each diamond cutter typically has a stud portion which is mounted in a recess in the exterior face of the bit body. Depending upon the design of the bit body and the type of diamonds used, the cutters are either positioned in a mold prior to formation of the bit body or are secured to the bit body after fabrication.

The cutting elements are positioned along the leading edges of the bit body, so that as the bit body is rotated in its intended direction of use, the cutting elements engage and drill the earth formation. In use, tremendous forces are exerted on the cutting elements, particularly in the forward to rear direction. Additionally, the bit and cutting elements are subjected to substantial abrasive forces. In some instances, impact, lateral and/or abrasive forces have caused drill bit failure and cutter loss.

While steel body bits have toughness and ductility properties, which render them resistant to cracking and failure due to impact forces generated during drilling, steel is subject to rapid erosion due to abrasive forces, such as high velocity drilling fluids, during drilling. Generally, steel body bits are hardfaced with a more erosion-resistant material containing tungsten carbide to improve their erosion resistance. However, tungsten carbide and other erosion-resistant materials are brittle. During use, the relatively thin hardfacing deposit may crack and peel, revealing the softer steel body, which is then rapidly eroded. This leads to cutter loss, as the area around the cutter is eroded away, and eventual failure of the bit.

Tungsten carbide or other hard metal matrix bits have the advantage of high erosion resistance. The matrix bit is generally formed by packing a graphite mold with tungsten carbide powder and then infiltrating the powder with a molten copper alloy binder. A steel blank is present in the mold and becomes secured to the matrix. The end of the blank can then be welded or otherwise secured to an upper threaded body portion of the bit.

Such tungsten carbide or other hard metal matrix bits, however, are brittle and can crack upon being subjected to impact forces encountered during drilling. Additionally, thermal stresses from the heat generated during fabrication of the bit or during drilling may cause cracks to form. Typically, such cracks occur where the cutter elements have been secured to the matrix body. If the cutter elements are sheared from the drill bit body, the expensive diamonds on the cutter elements are lost, and the bit may cease to drill. Additionally, tungsten carbide is very expensive in comparison with steel as a material of fabrication.

Accordingly, there is a need for a drill bit that has the toughness, ductility, and impact strength of steel and the hardness and erosion resistance of tungsten carbide or other hard metal on the exterior surface, but without the problems of prior art steel body and hard metal matrix body bits. There is also a need for an erosion-resistant bit with a lower total cost.

SUMMARY OF THE INVENTION

One embodiment of a system, method, and apparatus for enhancing the durability of earth-boring bits with carbide materials is disclosed. Drill bits having a drill bit body with a cutting component include a composite material formed from a binder and tungsten carbide crystals. In one embodiment, the crystals have a generally spheroidal shape, and a mean grain size range of about 0.5 to 8 microns. In one embodiment, the distribution of grain size is characterized by a Gaussian distribution having a standard deviation on the order of about 0.25 to 0.50 micron. The composite material may be used as a component of hardfacing on the drill bit body, or be used to form portions or all of the drill bit and/or its components.

In one embodiment, the tungsten carbide composite material comprises sintered spheroidal pellets. The pellets may be formed with a single mode or multi-modal size distribution of the crystals. The invention is well suited for many different types of drill bits including, for example, drill bit bodies with PCD cutters having substrates formed from the composite material, drill bit bodies with matrix heads, rolling cone drill bits, and drill bits with milled teeth.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
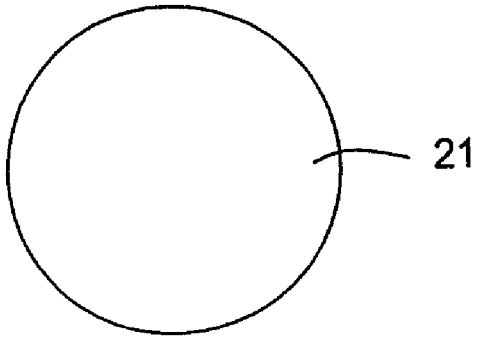
FIG. 1 is a schematic drawing of one embodiment of a single carbide crystal constructed in accordance with the present invention.

Referring to FIG. 1, one embodiment of a carbide crystal 21 constructed in accordance with the present invention is depicted in a simplified rounded form. In the embodiment shown, crystal 21 is formed from tungsten carbide (WC) and has a mean grain size range of about 0.5 to 8 microns, depending on the application. The term "mean grain size" refers to an average diameter of the particle, which may be somewhat irregularly shaped.

Figure 2:
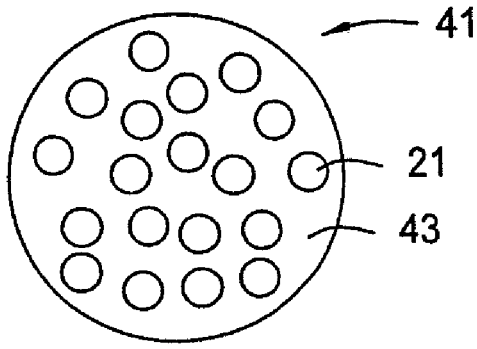
FIG. 2 is a schematic side view of one embodiment of a pellet formed from the carbide crystals of FIG. 1 and is constructed in accordance with the present invention.

Referring now to FIG. 2, one embodiment of the crystals 21 are shown formed in a sintered spheroidal pellet 41. Neither crystals 21 nor pellets 41 are drawn to scale and they are illustrated in a simplified manner for reference purposes only. The invention should not be construed or limited because of these representations. For example, other possible shapes include elongated or oblong rounded structures, etc.

Pellet 41 is suitable for use in, for example, a hardfacing for drill bits. The pellet 41 is formed by a plurality of the crystals 21 in a binder 43, such as an alloy binder, a transition element binder, and other types of binders such as those known in the art. In one embodiment, cobalt may be used and comprises about 6% to 8% of the total composition of the binder for hardfacing applications. In other embodiments, about 4% to 10% cobalt is more suitable for some applications. In other applications, such as using the composite material of the invention for the formation of structural components of the drill bit (e.g., bit body, cutting structure, etc.), the range of cobalt may comprise, for example, 15% to 30% cobalt.

Figure 3:
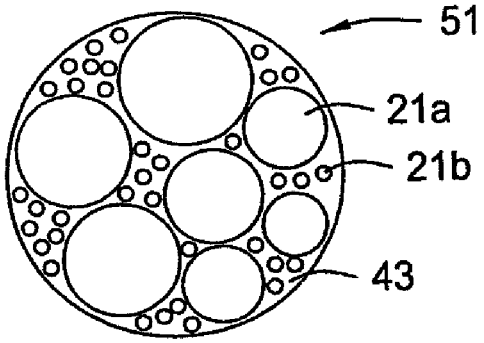
FIG. 3 is a schematic side view of one embodiment of a bi-modal pellet formed from different sizes of the carbide crystals of FIG. 1 and is constructed in accordance with the present invention.
Figure 4:
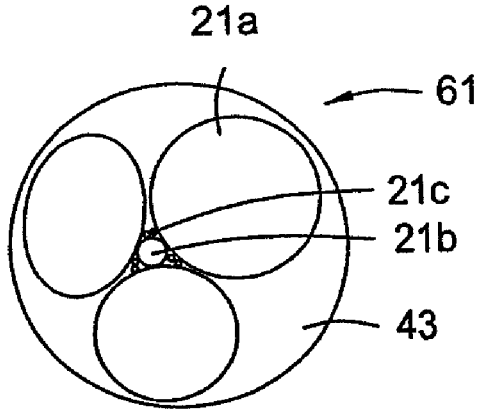
FIG. 4 is a schematic side view of one embodiment of a tri-modal pellet formed from different sizes of the carbide crystals of FIG. 1 and is constructed in accordance with the present invention.

Alternative embodiments of the invention include multi-modal distributions of the crystals. For example, FIG. 3 depicts a bi-modal pellet 51 that incorporates a spheroidal carbide aggregate of crystals 21 having two distinct and different sizes (i.e., large crystals 21*a* and small crystals 21*b*) in a binder 43. In one embodiment, the crystals 21*a*, 21*b* have a size ratio of about 7:1, and provide pellet 51 with a carbide content of about 88%. For example, the large crystals 21*a* may have a mean size of ≦8 microns, and the small crystals 21*b* may have a mean size of about 1 micron. Both crystals 21*a*, 21*b* exhibit the same properties and characteristics described herein for crystal 21. This design allows for a reduction in binder content without sacrificing fracture toughness.

In another embodiment (FIG. 4), a tri-modal pellet 61 incorporates crystals 21 of three different sizes (i.e., large crystals 21*a*, intermediate crystals 21*b*, and small crystals 21*c*) in a binder 43. In one version, the crystals 21*a*, 21*b*, 21*c* have a size ratio of about 35:7:1, and provide pellet 61 with a carbide content of greater than 90%. For example, the large crystals 21*a* may have a mean size of ≦8 microns, the intermediate crystals 21*b* may have a mean size of about 1 micron, and the small crystals 21*c* may have a mean size of about 0.03 micron. All crystals 21*a*, 21*b*, and 21*c* exhibit the same properties and characteristics described herein for the other embodiments. Again, the drawings depicted in FIGS. 1-4 are merely illustrative and are greatly simplified for ease of reference and understanding. These depictions are not intended to be drawn to scale, to show the actual geometry, or otherwise illustrate any specific features of the invention.

In still another embodiment, the invention comprises a hardfacing material having hard phase components (e.g., cast tungsten carbide, cemented tungsten carbide pellets, etc.) that are held together by a metal matrix, such as iron or nickel. The hard phase components include at least some of the crystals of tungsten carbide and binder that are described herein.

Figure 7:
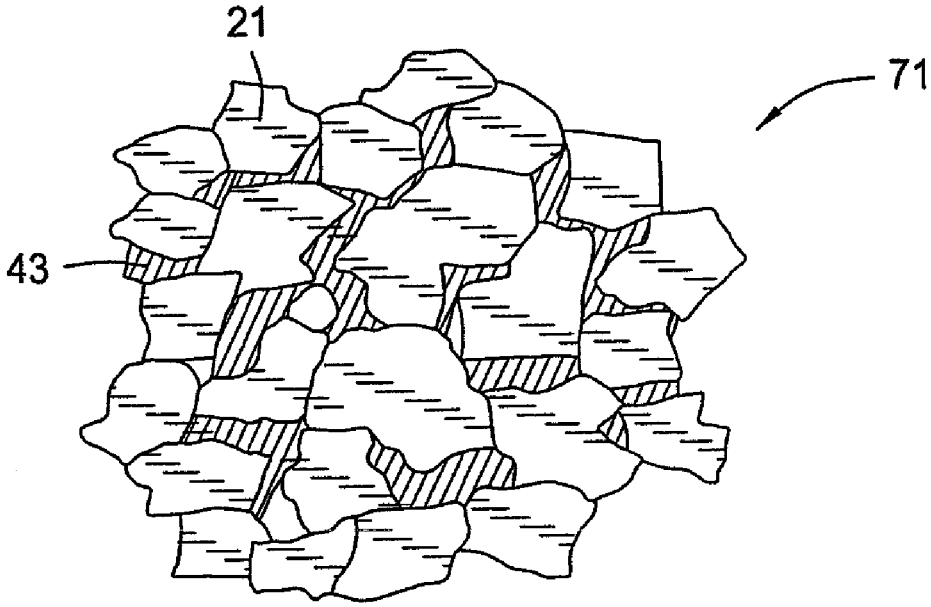
FIG. 7 is a schematic side view of one embodiment of an irregularly shaped particle formed from a bulk crushed and sintered, carbide crystal-based composite material and is constructed in accordance with the present invention.

Referring now to FIG. 7, another embodiment of the present invention is shown as a particle 71. Like the previous embodiments, particle 71 includes a plurality of the crystals 21 in a binder 43. However, particle 71 is generated by forming a large bulk quantity (e.g., a billet) of the crystal 21 and binder 43 composite (any embodiment), sintering the bulk composite, and then crushing the bulk composite to form particles 71. As shown in FIG. 7, the crushed particles 71 contain a plurality of crystals 21, have irregular shapes, and are non-uniform. The particles 71 are then sorted by size for selected applications such as those described herein.

Figure 12:
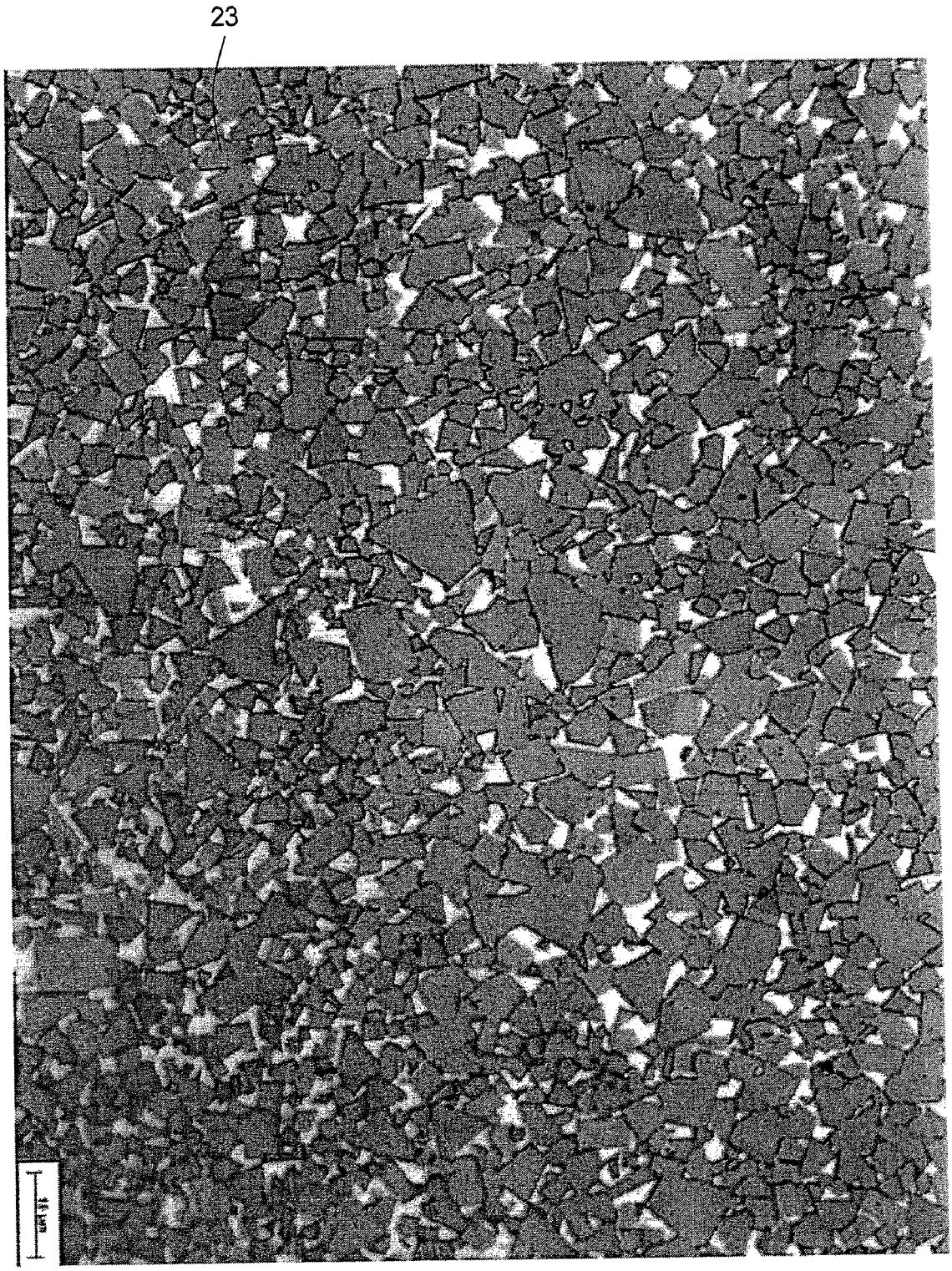
FIG. 12 (PRIOR ART)
FIG. 12 is a micrograph of conventional composite material.
Figure 13:
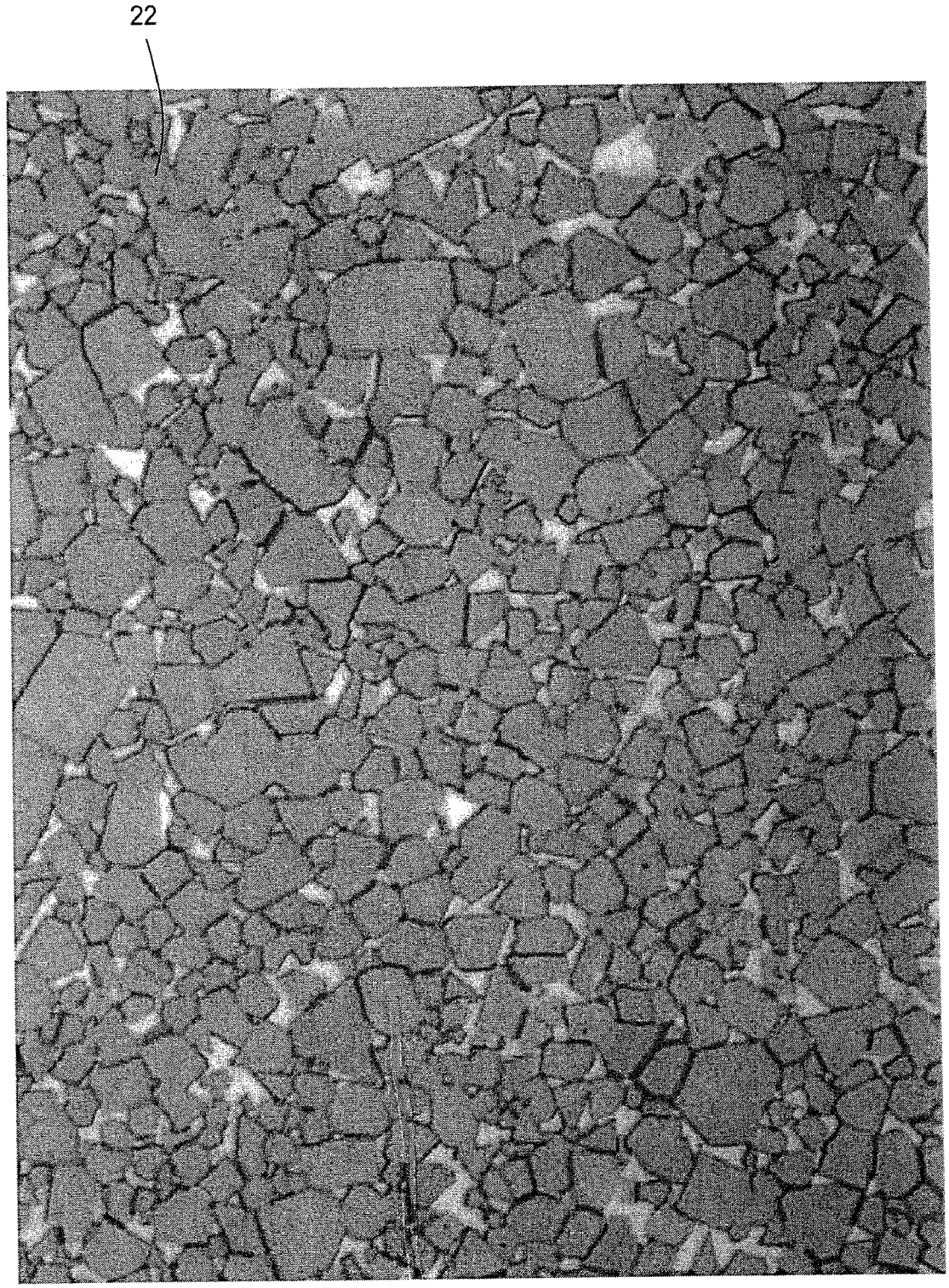
FIG. 13 is a micrograph of one embodiment of a composite material constructed in accordance with the present invention.

Comparing the composite materials of FIGS. 2-4 and 13 (collectively referred to with numeral 22 in FIG. 13) with the conventional composite material 23 having carbide crystals depicted in FIG. 12, composite material 22 in FIG. 13 is generally spheroidal, having a profile that is more rounded without angular structures such as sharp corners or edges. In contrast, the conventional composite material 23 of FIG. 12 is much less rounded and has many more sharp and/or jagged corners and edges.

Figure 5:
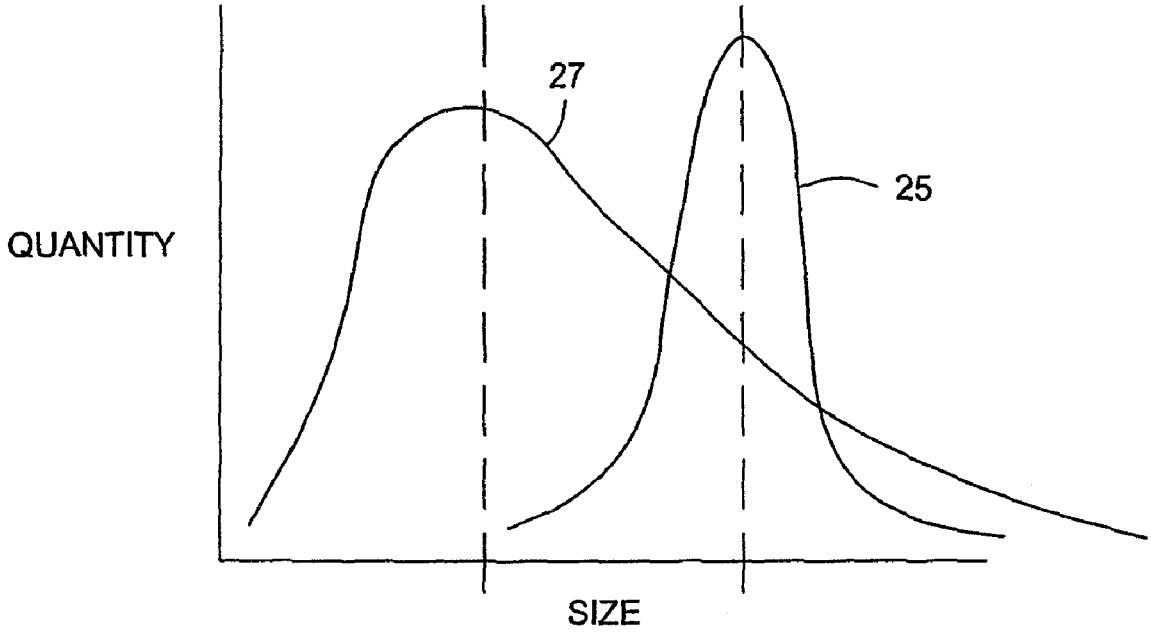
FIG. 5 is a plot of size distributions for samples of various embodiments of carbide crystals constructed in accordance with the present invention, compared to a sample of conventional crystals.

In addition, the composite material 22 of FIG. 13 is formed in batches with a much tighter size distribution than that of the conventional composite material 23 in FIG. 12. Thus, composite material 22 is much more uniform in size than conventional composite material 23. As shown in FIG. 5, a plot of a typical distribution 25 of crystals 21 may be characterized as a relatively narrow Gaussian distribution, whereas a plot of a typical distribution 27 of conventional crystals may be characterized as log-normal (i.e., a normal distribution when plotted on a logarithmic scale). For example, for a mean target grain size of 5 microns, the standard deviation for crystals 21 is on the order of about 0.25 to 0.50 micron. In contrast, for a mean target grain size of 5 microns, the standard deviation for conventional crystals is about 2 to 3 microns.

Figure 6:
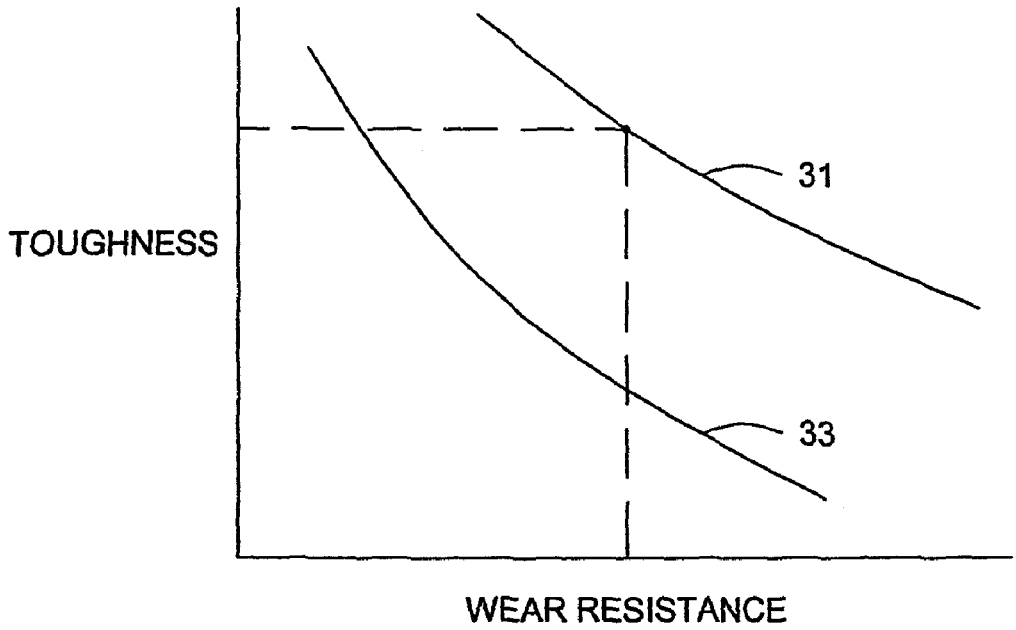
FIG. 6 is a plot of wear resistance and toughness for samples of various embodiments of composite materials constructed in accordance with the present invention compared to a sample of conventional composite material.

A composite material of the present invention that incorporates crystals 21 has significantly improved performance over conventional materials. For example, the composite material is both harder (e.g., wear resistant) and tougher than prior art materials. As shown in FIG. 6, plot 31 for the composite material of the present invention depicts a greater hardness for a given toughness, and vice versa, compared to plot 33 for conventional composite materials. In one embodiment, the composite material of the present invention has 70% more wear resistance for an equivalent toughness of conventional carbide materials, and 50% more fracture toughness for an equivalent hardness of conventional carbide materials.

Figure 8:
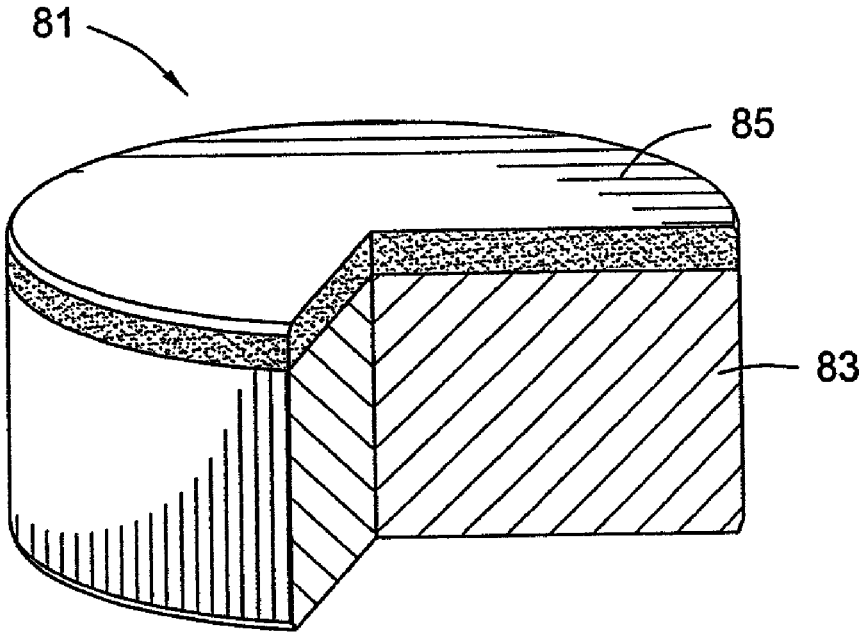
FIG. 8 is a partially sectioned side view of one embodiment of a drill bit polycrystalline diamond (PCD) cutter incorporating carbide crystals constructed in accordance with the present invention.
Figure 11:
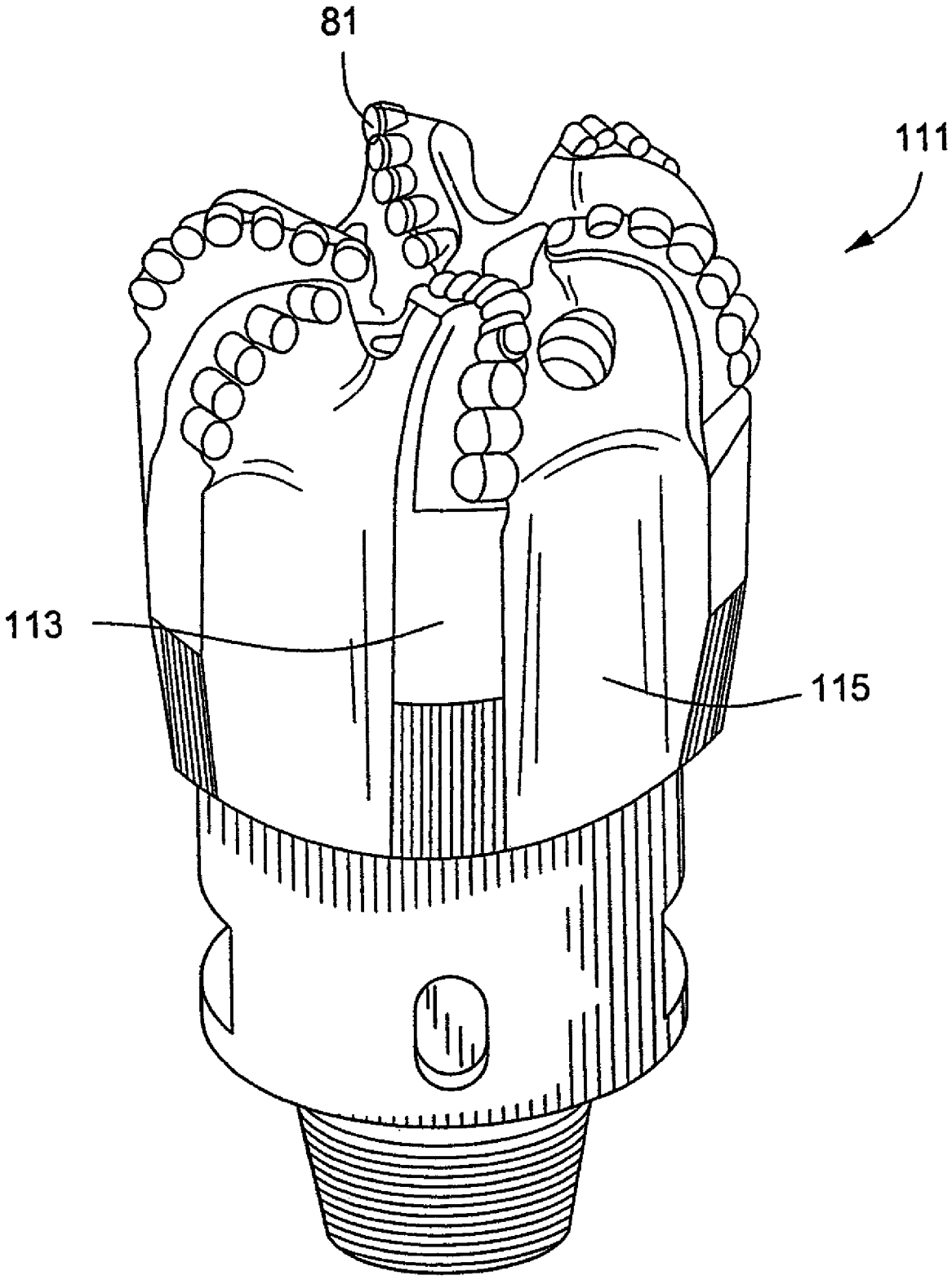
FIG. 11 is an isometric view of one embodiment of a polycrystalline diamond (PCD) drill bit incorporating carbide crystals constructed in accordance with the present invention.
Figure 14:
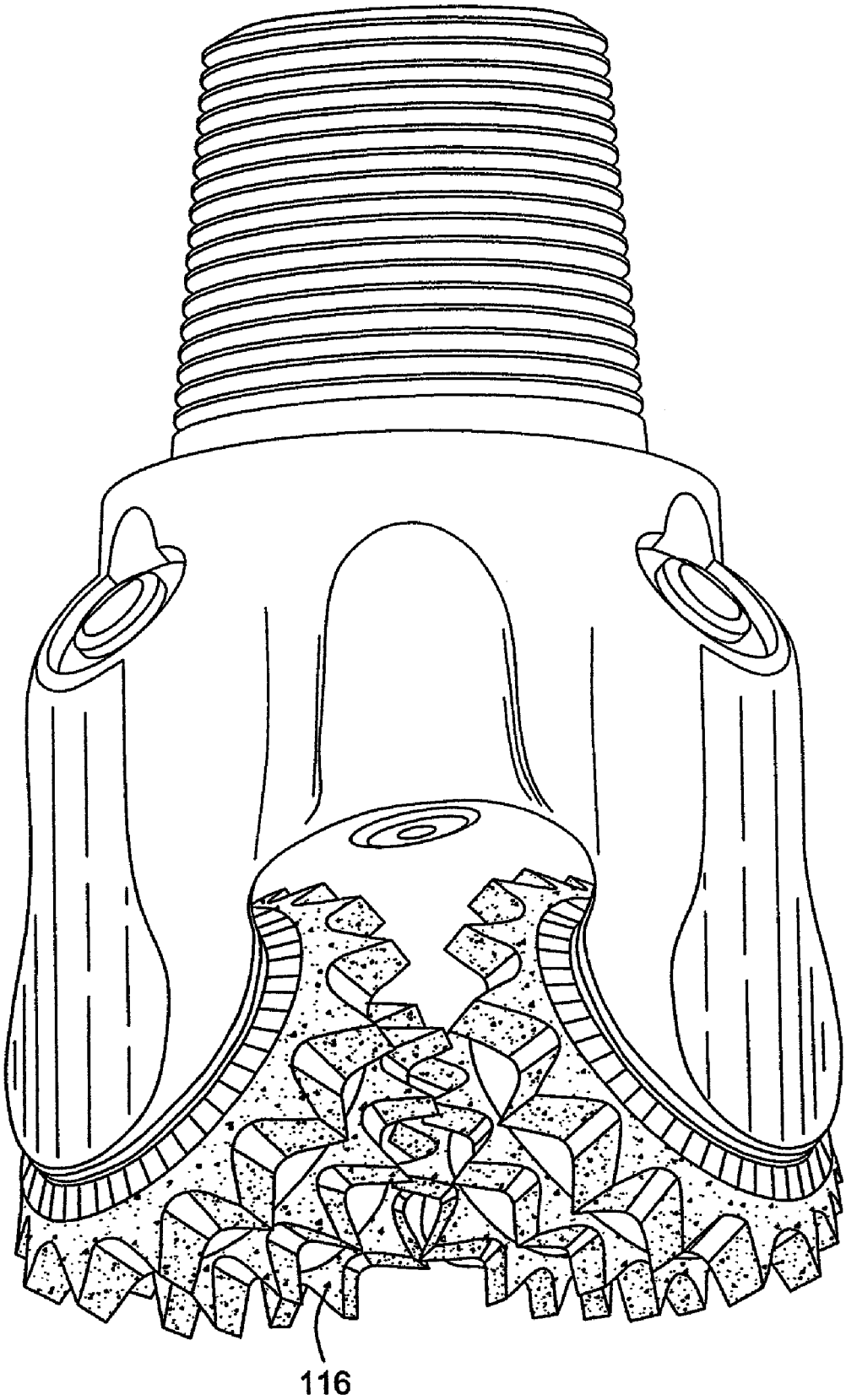
FIG. 14 is an isometric view of another embodiment of a drill bit incorporating a composite material constructed in accordance with the present invention.

There are many applications for the present invention, each of which may use any of the embodiments described herein. For example, FIG. 8 depicts a drill bit polycrystalline diamond (PCD) cutter 81 that incorporates a substrate 83 formed from the previously described composite material of the present invention with a diamond layer 85 formed thereon. Cutters 81 may be mounted to, for example, a drill bit body 115 (FIG. 11) of the drill bit 111. Alternatively or in combination, the PCD drill bit 111 may incorporate the composite material of the present invention as either hardfacing 113 on bit 111, or as the material used to form portions of or the entire bit body 115, such as the cutting structures. In another alternate embodiment (FIG. 14), portions or all of the cutting structures 116 (e.g., teeth, cones, etc.) may incorporate the composite material of the present invention.

Figure 9:
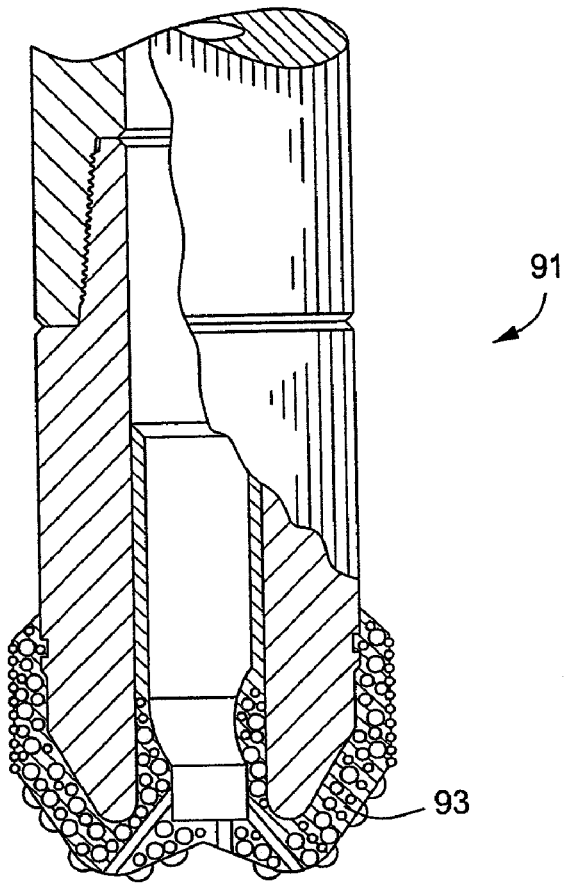
FIG. 9 is a partially sectioned side view of one embodiment of a drill bit having a matrix head incorporating carbide crystals constructed in accordance with the present invention.
Figure 10:
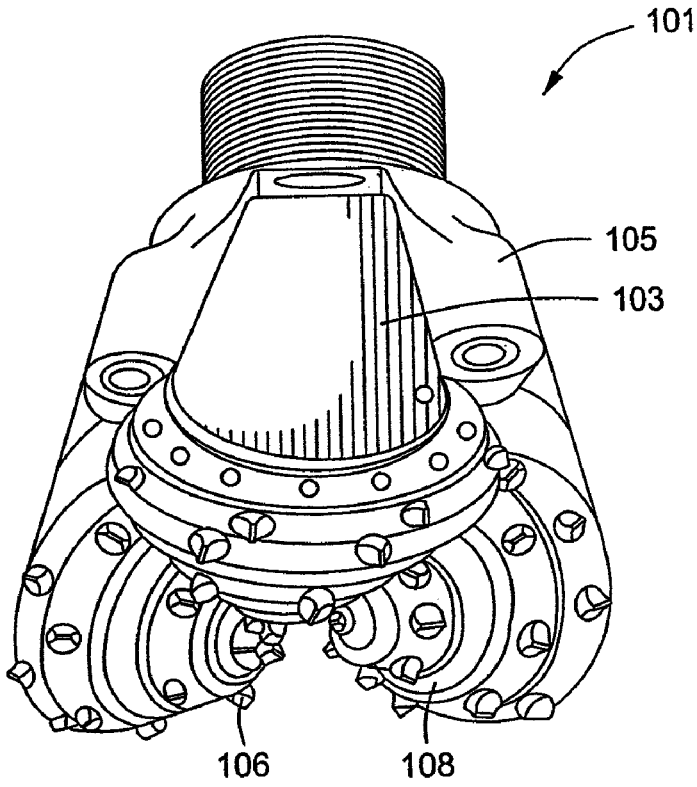
FIG. 10 is an isometric view of one embodiment of a rolling cone drill bit incorporating carbide crystals constructed in accordance with the present invention.

In still another embodiment, FIG. 9 illustrates a drill bit 91 having a matrix head 93 that incorporates the composite material of the present invention. FIG. 10 depicts a rolling cone drill bit 101 incorporating the composite material of the present invention as hardfacing 103 on portions of the bit body 105 or cutting structure (e.g., inserts 106), on the entire bit body 105 or cutting structure (including, e.g., the cone support 108), or as the material used to form portions of or the entire bit body 105 or cutting structure. Bits with milled teeth are also suitable applications for the present invention. For example, such applications may incorporate hardfaced teeth, bit body portions, or complete bit body structures fabricated with the composite material of the present invention.

While the invention has been shown or described in only some of its forms, it should be apparent to those skilled in the art that it is not so limited, but is susceptible to various changes without departing from the scope of the invention.

What is claimed is:

1. A composite material, comprising:

multi-modal, sintered spheroidal pellets that incorporate an aggregate of at least two different sizes of crystals of tungsten carbide and a binder, the crystals having a generally spheroidal shape, a mean grain size range of about 0.5 to 8 microns, and a distribution of which is characterized by a Gaussian distribution having a standard deviation on the order of about 0.25 to 0.50 micron, the aggregate of the at least two different sizes of the crystals comprising:

one size of the crystals having a mean size of ≦8 microns;

another size of the crystals having a mean size of about 1 micron; and a size ratio of about 7:1;

the composite material having a tungsten carbide content of about 88% or greater.

2. A composite material according to claim 1, wherein:

the multi-modal, sintered spheroidal pellets comprise bi-modal, sintered spheroidal pellets that incorporate the aggregate of the at least two different sizes of the crystals, the aggregate of the at least two different sizes of the crystals comprising an aggregate of two different sizes of the crystals comprising:

the one size of the crystals having the mean size of ≦8 microns;

the another size of the crystals having the mean size of about 1 micron; and the size ratio of about 7:1, the size ratio of about 7:1 being a ratio of the one size to the another size;

the composite material having a tungsten carbide content of about 88%.

3. A composite material according to claim 1, wherein:

the multi-modal, sintered spheroidal pellets comprise tri-modal, sintered spheroidal pellets that incorporate the aggregate of the at least two different sizes of the crystals, the aggregate of the at least two different sizes of the crystals comprising an aggregate of three different sizes of the crystals comprising:

the one size of the crystals having the mean size of ≦8 microns;

the another size of the crystals having the mean size of about 1 micron;

a third size of the crystals having a mean size of about 0.03 micron;

the size ratio of about 7:1, the size ratio of about 7:1 being a ratio of the another size of the crystals to the third size of the crystals; and another size ratio of about 35:7:1, the another size ratio of about 35:7:1 being a ratio of the one size of the crystals to the another size of the crystals to the third size of the crystals;

the composite material having a tungsten carbide content of greater than 90%.

4. A hardfacing material for drill bits, the hardfacing material comprising:

hard phase components held together by a metal matrix, the hard phase components comprising crystals of tungsten carbide and a binder, the crystals having a generally spheroidal shape, a mean grain size range of about 0.5 to 8 microns, and a distribution of which is characterized by a Gaussian distribution having a standard deviation on the order of about 0.25 to 0.50 micron.

5. A hardfacing material according to claim 4, wherein the hard phase components comprise at least one of cast tungsten carbide and cemented tungsten carbide pellets.

6. A hardfacing material according to claim 4, wherein the metal matrix comprises one of iron and nickel.

7. A hardfacing material according to claim 4, wherein the hardfacing material comprises bi-modal, sintered spheroidal pellets that incorporate an aggregate of two different sizes of the crystals, and the two different sizes of the crystals have a size ratio of about 7:1, provide the hardfacing material with a tungsten carbide content of about 88%, a larger size of the crystals has a mean size of ≦8 microns, and a smaller size of the crystals has a mean size of about 1 micron.

8. A hardfacing material according to claim 4, wherein the hardfacing material comprises tri-modal, sintered spheroidal pellets that incorporate an aggregate of three different sizes of the crystals, and the three different sizes of the crystals have a size ratio of about 35:7:1, provide the hardfacing material with a carbide content of greater than 90%, a largest size of the crystals has a mean size of ≦8 microns, an intermediate size of the crystals has a mean size of about 1 micron, and a smallest size of the crystals has a mean size of about 0.03 micron.

9. A method of forming a composite material, comprising:

providing a multi-modal aggregate of one size of crystals of tungsten carbide and another size of crystals of tungsten carbide, each of the one size of crystals and the another size of crystals having a mean grain size range of about 0.5 to 8 microns with a distribution characterized by a Gaussian distribution having a standard deviation on the order of about 0.25 to 0.5 micron;

forming a bulk composite of the crystals and a binder, the one size of crystals of the multi-modal aggregate intermixed throughout the bulk composite with the another size of crystals of the multi-modal aggregate;

sintering the bulk composite;

crushing the bulk composite to form crushed particles having non-uniform, irregular shapes; and sorting the crushed particles by size for use in selected applications.

10. A method according to claim 9, wherein forming a bulk composite of the crystals and a binder comprises forming a billet of the crystals and binder.

11. A method according to claim 9, wherein providing a multi-modal aggregate comprises formulating bi-modal, sintered spheroidal pellets each comprising an aggregate of two different sizes of crystals of tungsten carbide including one size of crystals of tungsten carbide and another size of crystals of tungsten carbide; the one size of crystals and the another size of crystals having a size ratio of about 7:1; the composite material having a tungsten carbide content of about 88%; the one size of crystals having a mean size of ≦8 microns; and the another size of crystals having a mean size of about 1 micron.

12. A method according to claim 9, wherein providing a multi-modal aggregate comprises formulating tri-modal, sintered spheroidal pellets each comprising an aggregate of three different sizes of crystals of tungsten carbide including one size of crystals of tungsten carbide, another size of crystals of tungsten carbide, and yet another size of crystals of tungsten carbide; the one size of crystals, the another size of crystals, and the yet another size of crystals having a size ratio of about 35:7:1; the composite material having a carbide content of greater than 90%; the one size of crystals having a mean size of ≦8 microns; the another size of crystals having a mean size of about 1 micron; and the yet another size of crystals having a mean size of about 0.03 micron.

13. A method of forming a composite material, comprising:

providing crystals of tungsten carbide having a mean grain size range of about 0.5 to 8 microns, a distribution of which is characterized by a Gaussian distribution having a standard deviation on the order of about 0.25 to 0.5 micron; and forming pellets of the crystals and a binder, each of the pellets incorporating a multi-modal aggregate of one size of the crystals intermixed throughout the pellet with another size of the crystals.

14. A method according to claim 13, wherein forming pellets of the crystals and a binder comprises forming sintered spheroidal pellets of the crystals and a binder; each of the pellets incorporating a bi-modal aggregate of the one size of the crystals intermixed throughout the pellet with the another size of the crystals; the one size of the crystals and the another size of the crystals having a size ratio of about 7:1; the composite material having a tungsten carbide content of about 88%; the one size of the crystals having a mean size of ≦8 microns; and the another size of the crystals having a mean size of about 1 micron.

15. A method according to claim 13, wherein forming pellets of the crystals and a binder comprises forming sintered spheroidal pellets of the crystals and a binder; each of the pellets incorporating a tri-modal aggregate of the one size of the crystals intermixed throughout the pellet with the another size of the crystals and a third size of the crystals; the one size of the crystals, the another size of the crystals, and the third size of the crystals having a size ratio of about 35:7:1; the composite material having a carbide content of greater than 90%; the one size of the crystals having a mean size ≦8 microns; the another size of the crystals having a mean size of about 1 micron; and the third size of the crystals having a mean size of about 0.03 micron.

* * * * *